United States Patent [19]

Rousset et al.

[11] Patent Number: 4,736,770

[45] Date of Patent: Apr. 12, 1988

[54] HYDRAULIC DISTRIBUTOR OF THE PROPORTIONAL TYPE, WITH LOAD SENSING OF THE HIGHEST PRESSURES IN THE OPERATING CIRCUITS

[76] Inventors: Andrè Rousset, 8 Rue Du 19 Mars 1962, Saint Priets En Jarzez; Maurice Tardy, 20 Rue Eugene Joly, Saint Etienne, both of Loire, France

[21] Appl. No.: 936,920

[22] Filed: Nov. 28, 1986

Related U.S. Application Data

[63] Continuation of Ser. No. 724,523, Apr. 18, 1985, abandoned.

[30] Foreign Application Priority Data

Apr. 18, 1984 [FR] France ..... 84 06747

[51] Int. Cl.[4] ..... F15B 13/02

[52] U.S. Cl. ..... 137/596; 60/452; 91/446; 137/596.13

[58] Field of Search ..... 60/452; 91/446; 137/596, 596.13

[56] References Cited

U.S. PATENT DOCUMENTS

| | | | |
|---|---|---|---|
| 3,742,982 | 7/1973 | Miller | 60/452 X |
| 3,815,477 | 6/1974 | Ailshie | 137/596.13 X |
| 3,828,813 | 8/1974 | Haussler | 137/596.13 |
| 3,881,512 | 5/1975 | Wilke | 137/596.13 |
| 3,971,216 | 7/1976 | Miller | 137/596.13 X |
| 4,020,867 | 5/1977 | Sumiyoshi | 137/596.13 |
| 4,051,868 | 10/1977 | Anderson | 137/596.13 |
| 4,133,510 | 1/1979 | Lorimor | 137/596.13 X |
| 4,246,934 | 1/1981 | Budzich | 137/596.13 |
| 4,343,152 | 8/1982 | Habiger | 137/596.13 X |
| 4,515,181 | 5/1985 | Dezelan | 137/596.13 X |
| 4,548,239 | 10/1985 | Eskildsen | 137/596.13 X |

*Primary Examiner*—Gerald A. Michalsky
*Attorney, Agent, or Firm*—Remy J. Van Ophem

[57] ABSTRACT

A progressive hydraulic distributor with a slide for controlling a hydraulic actuator. The distributor has an internal load sensing passage that detects the operating pressure in the hydraulic fluid inlet or outlet passage and superimposes this pressure on the action of the spring of a feed valve. Thus, the difference between the up-flow and the down-flow of progressivity in the slide of the distributor is constant.

4 Claims, 4 Drawing Sheets

HYDRAULIC DISTRIBUTOR OF THE PROPORTIONAL TYPE, WITH LOAD SENSING OF THE HIGHEST PRESSURES IN THE OPERATING CIRCUITS

This is a continuation of application Ser. No. 724,523, filed Apr. 18, 1985, now abandoned.

BACKGROUND OF THE INVENTION

The invention relates to a distributor of the type used in hydraulic systems for controlling the flow of hydraulic fluid to and from one or more hydraulic actuators, for example, hydraulic cylinders, pumps, or motors. Such installations are used to control the operation of machines, machine tools and civil engineering equipment, in aviation and on various vehicles.

An hydraulic distributor is interposed between one or more hydraulic generator hydraulic actuators, and provides a circuit for the supply of fluid under pressure and a return circuit. It is normal practice to group several distributors in a single control position, especially on vehicles or on civil engineering equipment, in such a way as to make several hydraulic connections simultaneously in order to operate several hydraulic actuators, such as several cylinders, for example, at the same time.

Each distributor includes a slide that is able to move through several positions. The distributor is said to be of the proportional type when, for a given movement of the slide, a given constant output is obtained in the operating circuit independent of the conditions of force or couple encountered by the receiver, cylinder or similar device.

The present invention especially relates to a proportional hydraulic distributor of this type which has, in addition, a sensor for sensing the value of the pressure required by the actuator that is being operated by the distributor.

In a multiple hydraulic actuator hydraulic system, the sensor, known as a "load sensor", transmits the value of the highest pressure required by any of the actuators to a pressure regulator that is a part of the hydraulic system. This allows the pressure to be regulated to the exact value necessary for feeding the actuators.

SUMMARY OF THE INVENTION

A proportional hydraulic distributor according to the present invention has a distributing slide that is movable in a bore in a stator and is operated by at least one pilot pressure so that the slide, which is provided with progressivity slots, moves across apertures provided in the bore of the stator. The feed of hydraulic fluid to the distributor is by way of a feed passage that has a non-return valve arranged inside a pressure-compensating slide. Within the stator there is a pressure detection channel which communicates with a spring chamber of the compensating slide, so as to superimpose the action of the pressure in the pressure detection channel upon the action of a spring that acts on the feed valve, and with at least one distributing chamber in the stator which the slide puts alternatively in communication with the return circuit when the slide is in the neutral rest position, or with the operating circuit when the slide is feeding this circuit.

According to another characteristic of the present invention, the distributing slide has three positions, namely two switch positions and a neutral position, the switch positions being located one on either side of the central neutral position. In this case the slide allows a central feed to be put in communication with one or the other of two operating channels located one on either side, the pressure detection channel then communicating, by each of its two ends, with a chamber which the slide connects to the return circuit when the other chamber is connected to the corresponding operating channel, and vice versa.

According to another characteristic of the invention, each operating pressure detection channel is connected to an "OR" function which receives and reacts to the load pressure information, the assembly of the "OR" functions of the various distributors thus allowing the value of the highest of the operating pressures to be selected. In this case, the chosen information is directed towards the device for regulating the feed pressure of the distributing group.

According to another characteristic of the invention, the arrangement of the detection channel for the operating pressure allows the force resulting from action of this operating pressure to be superimposed on the force of the calibration spring of the compensating slide; this guarantees a constant value in the pressure difference on either side of the progressivity slots in the slide which are provided to direct the fluid towards the operating circuit.

According to another characteristic of the invention, the return spring of the compensating slide is provided with a stop adjusted by a screw allowing its calibration to be adjusted.

According to another characteristic of the invention, an extra-feed valve is mounted in parallel on each operating channel, sending the return pressure towards a receiving apparatus.

The attached drawings, given by way of non-limiting example, will allow the characteristics of the invention to be better understood.

DETAILED DESCRIPTION OF THE PREFERRED EMBODIMENT

Figure 1:
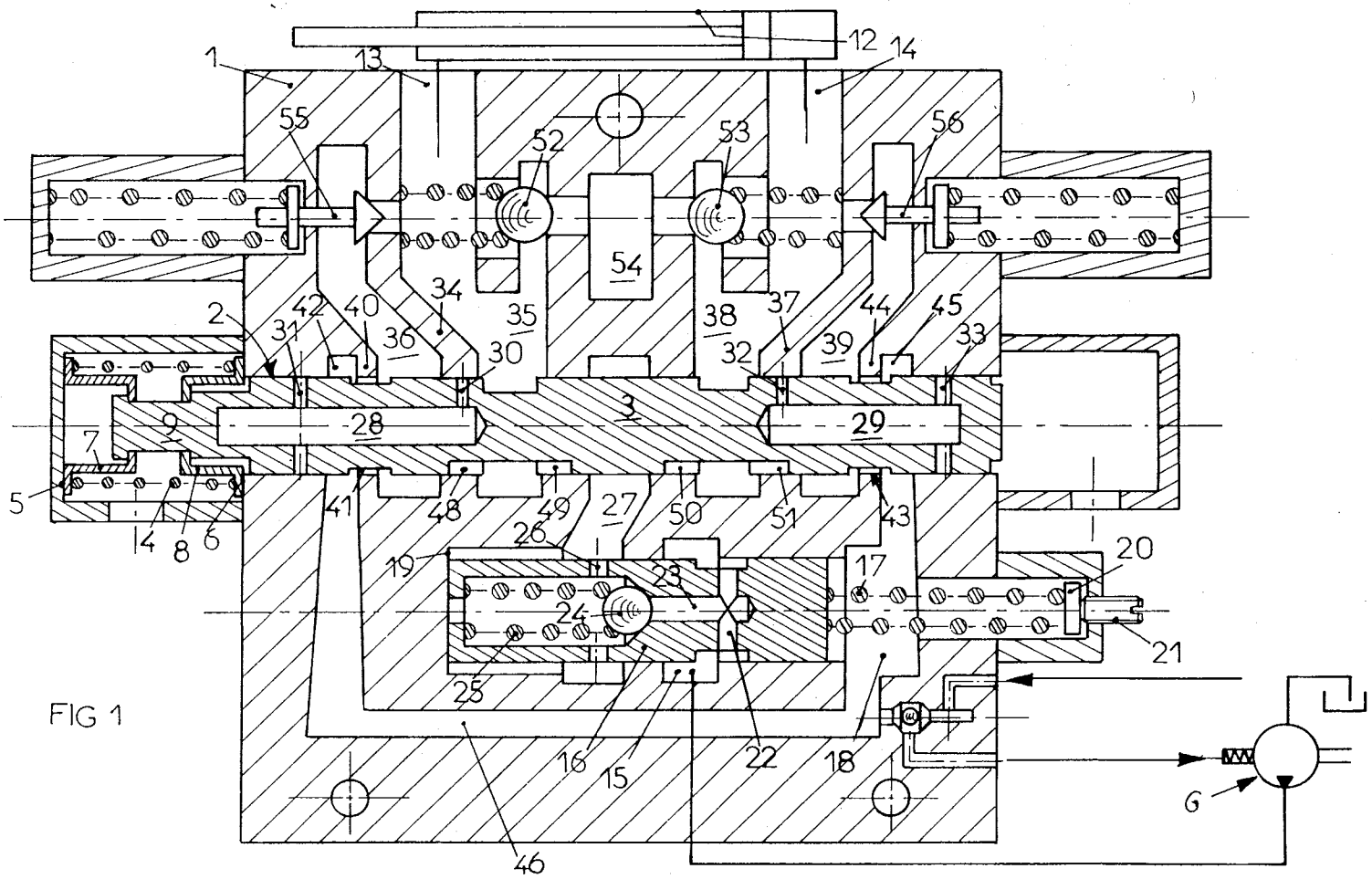
FIG. 1 is a view in axial section of a preferred embodiment of an hydraulic distributor according to the invention, in which the slide is in the neutral rest position.

The distributor shown in the drawings has a stator block 1 with a bore 2 extending therethrough. A cylindrical distributing slide 3 is slidable within the bore 2 of the stator block. Normally, the switching of the hydraulic circuits is carried out by displacement of the grooves in the slide 3 in relation to apertures in the stator block 1.

Figure 2:
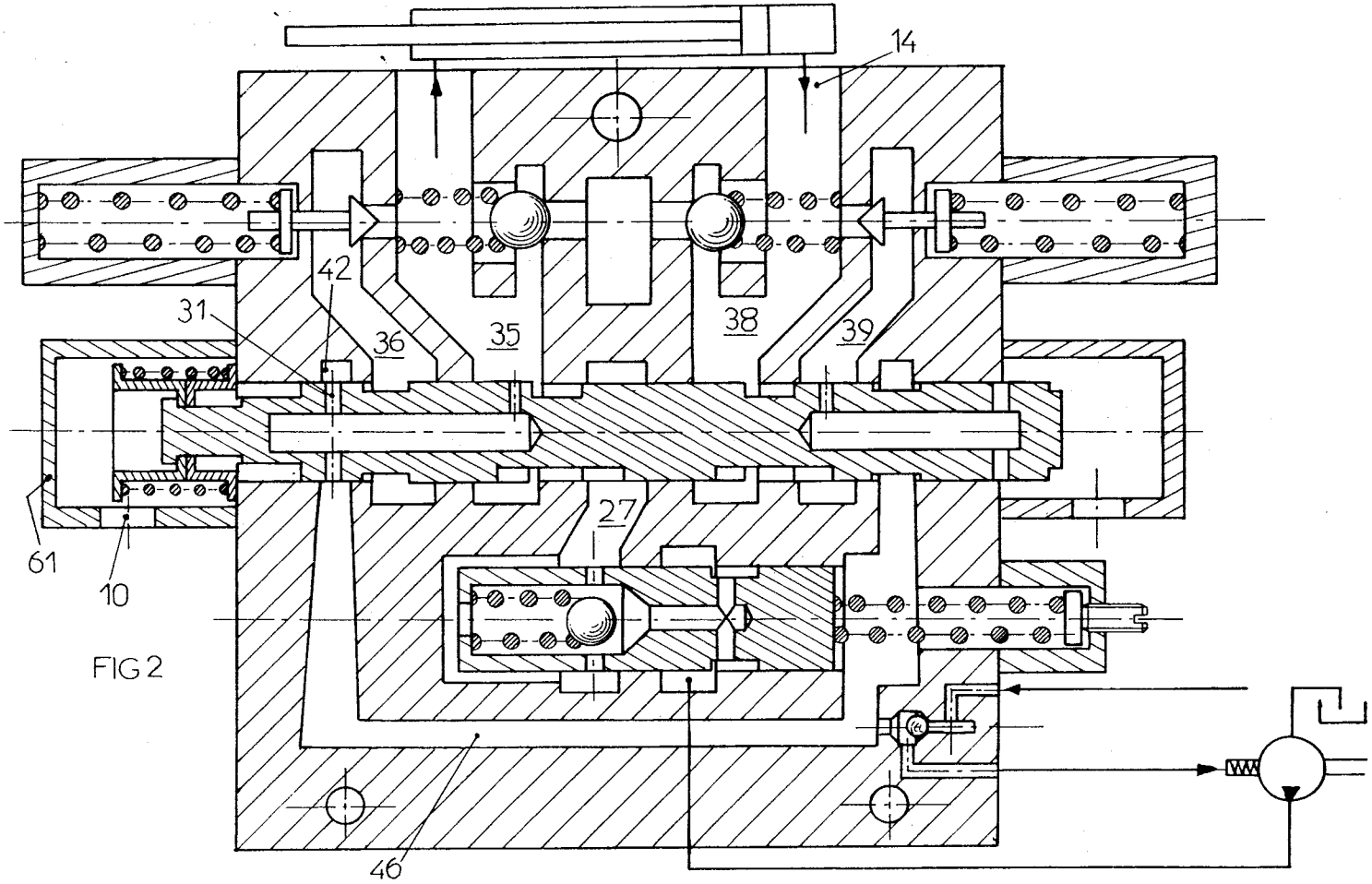
FIGS. 2 and 3 are views which are similar to FIG. 1 showing, respectively, the two operating positions of the slide, one on either side of its central neutral position.
Figure 3:
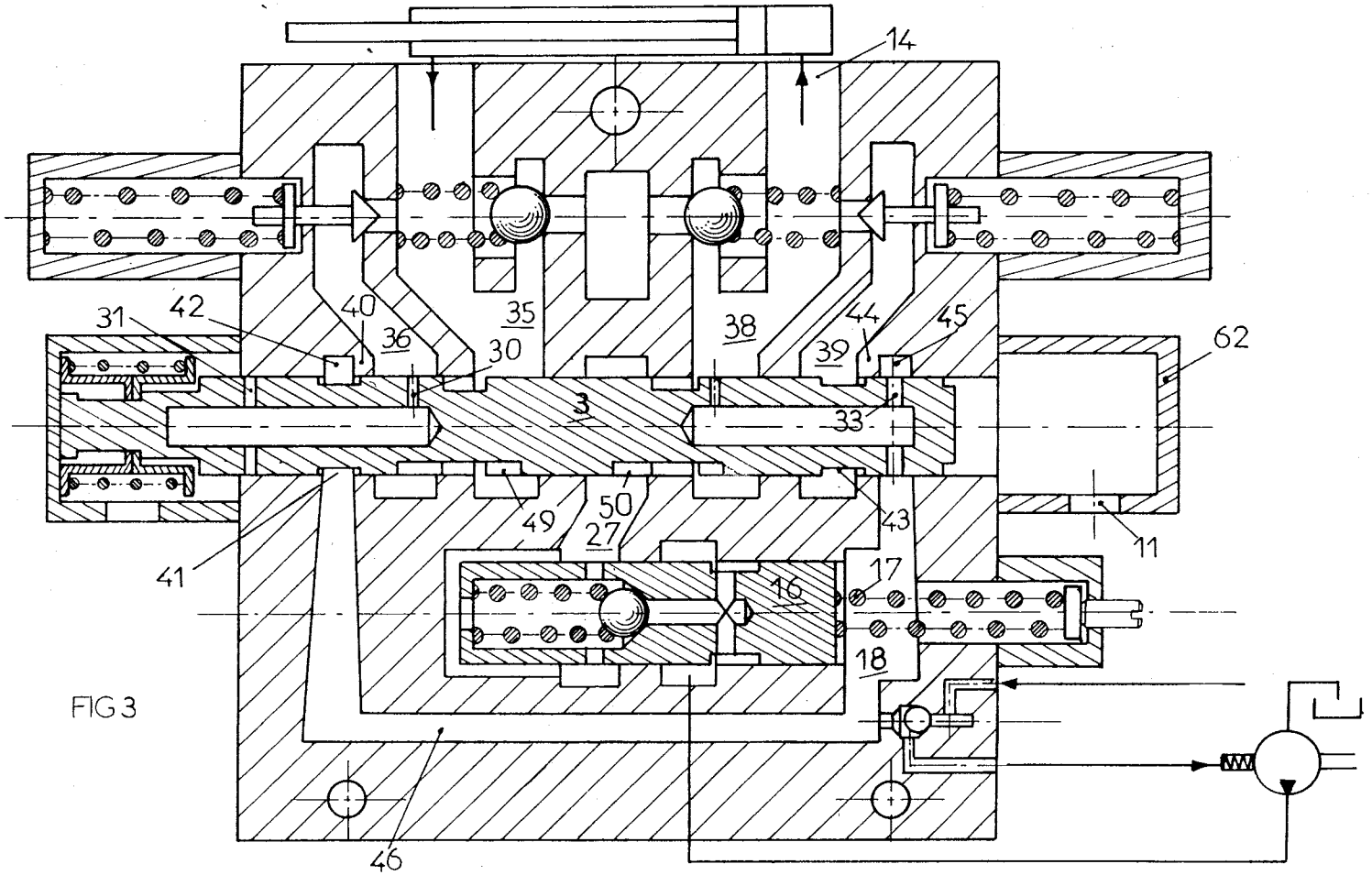
Figure 4:
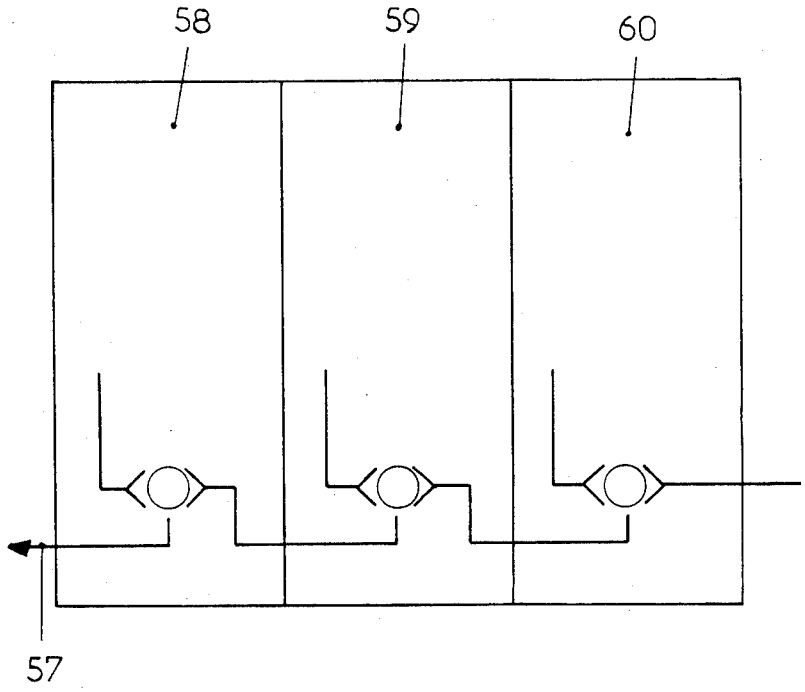
FIG. 4 is a diagram of the connection of several juxtaposed distributors according to the invention.

At its left hand end, for example, the slide 3 is provided with a device for a spring return of a known type, including a coil spring 4 compressed between flanges 5 and 6 of two rings 7 and 8, respectively. The rings 7 and 8 are trapped between two shoulders in an end 9 of the slide 3, the rings 7 and 8 being able to slide between these shoulders. Thus, in its neutral rest position, the slide 3 is in the position shown in FIG. 1, while as is shown in FIG. 2, it is pushed to the right when a pilot pressure is impressed on the end 9 of the slide 3 through an aperture 10 in a fixed cap 61 that surrounds the end 9. As is shown in FIG. 3, the slide 3 is pushed towards the left when a pilot pressure is impressed on the opposite end of the slide 3 through an aperture 11 in a cap 62 that surrounds the other end of the slide 3.

In the illustrated embodiment the three-position slide 3 is used to control a double-acting hydraulic cylinder 12. For this, one of the sections of the cylinder 12 is connected to a first operating passage 13 in the stator block 1, and the other section of the cylinder 12 is connected to a second operating passage 14 in the stator block 1.

An annular feed chamber 15 receives pressurized hydraulic fluid from a hydraulic generator G. The annular feed chamber 15 surrounds a movable cylindrical compensating slide 16, and a compression spring 17, which is located in chamber 18, biases the slide 16 against a fixed seat 19. In addition, the spring 17 bears on a base 20 and the position of the base 20 can be regulated by a calibrating screw 21.

The slide 16 is provided with a radial passage 22 which communicates with a blind axial passage 23. The blind axial a passage 23 opens at a seat which may be blocked or opened by a ball 24, and a return spring 25 is compressed within the movable slide 16 between the end thereof and the ball 24. The chamber containing the ball 24 and the return spring 25 opens through a radial aperture 26 into an annular chamber 27 surrounding the central part of the distributing slide 3.

Each of the two ends of the distributing slide 3 includes an internal axial passage, passage 28 on the left and passage 29 on the right. The internal axial passage 28 communicates with the exterior of the slide 3 through two radial ports identified, respectively, by reference numerals 30 and 31. Similarly, the internal axial passage 29 has two radial ports, identified, respectively, be reference numerals 32 and 33.

When the slide 3 is in its neutral rest position, as shown in FIG. 1, the radial port 30 is positioned opposite a land 34 in the stator block 1, and the land 34 is blocked between two annular chambers 35 and 36. The annular chamber 35 communicates with the first operating passage 13, and the annular chamber 36 is connected to a return circuit.

Likewise, the radial port 32 is blocked in the rest position by a land 37 located between two annular chambers 38 and 39. The annular chamber 38 communicates with the second operating channel 14, and the annular chamber 39 is connected to the return circuit.

The stator block 1 has a land 40 positioned between the radial ports 30 and 31 and a groove 41. The slide 3 is able to move within the groove 41.

The stator block 1 also has an annular chamber 42 extending around the slide 3. The annular chamber 42 is positioned so that, when the slide 3 is at the right, as in shown in FIG. 2, the radial port 31 will be aligned with the annular chamber 42.

Likewise, the slide 3 has a groove 43 at its other end, and the groove 43 is movable opposite a land 44 in the stator and there is an annular chamber 45 in the stator which extends around the slide 3 and is positioned to be aligned with the radial port 33 when the slide 3 is at the left, as is shown in FIG. 3.

The two annular chambers 42 and 45 are connected by a passage 46 known as "the passage for the detection of operating pressure" or "load sensing" passage and the passage 46 communicates permanently with the chamber 18 that surrounds the spring 17.

The periphery of the slide 3 is provided with longitudinally extending progressivity slots, identified by reference numerals 48, 49, 50 and 51.

The hydraulic distributor of the present invention also has a first extra-feed valve 52 operating in parallel with the first operating passage 13 and a second extra-feed valve 53 operating in parallel with the second operating passage 14. A chamber 54 is positioned between the first and second extra-feed valves 52 and 53 and is connected to the oil return circuit.

Overload valves 55 and 56 are provided in communication with each of the operating passages 13 and 14, respectively. The overload valves 55 and 56 allow a flow into the annular return chambers 36 and 39, respectively.

The operation of the invention is as follows:

The distributing function is carried out by displacement of the slide 3 to either side of the central neutral position illustrated in FIG. 1. The displacement is obtained by sending a pilot pressure through the aperture 10, to move the slide 3 to the right, as shown in FIG. 2, or through the aperture 11 to move the slide 3 to the left, as shown in FIG. 3. The extent of the movement of the slide 3 is controlled by the value of the pilot pressure, with the force exerted by the pilot pressure being balanced by the opposing thrust of the coil spring 4 which is compressed to a greater or lesser extent.

It will be seen that in the case of FIG. 2, the feed pressure in the annular chamber 27 is transmitted to the first operating passage 13, and the second operating passage 14 communicates with the return chamber 39. The cylinder 12 is, therefore, forced to contract. On the other hand, in the case of FIG. 3, the feed pressure in the annular chamber 27 is transmitted to the second operating passage 14, so that the cylinder 12 is forced to extend, and the first operating passage 13 is connected to the return chamber 36.

The function of load sensing, that is to say the pressure in the first operating passage 13 in the case of FIG. 2, or the pressure in the second operating passage 14 the case of FIG. 3, is communicated to the load sensing passage 46. The load sensing passage 46 is connected by the grooves 41 and 43 of the slide 3, in conjunction with the lands 40 and 44 in the bore, to the return channels through the chambers 36 and 39.

When the slide 3 is moved to the position shown in FIG. 2, the following actions take place in succession: the load sensing passage 46 is disconnected from the return 36 or 39; the radial ports 30 and 31 are uncovered; and the progressivity slots 49 and 50 are opened.

This timing of the operations shows that the connection between the first passage 13 and the load sensing passage 46 is made by the uncovering of the radial ports 30 and 31. Information relating to load pressure is transmitted from the load sensing passage 46 to several distributors such as the side-by-side distributors 58, 59 and 60. Each of the distributors 58, 59 and 60 is of the type shown in FIGS. 1 and 3. Hence, the common duct 57, in which the information of load pressure is treated by the "OR" functions, allows the greatest of these loads to be selected, which decides the highest of the operating pressures of the whole of the group of distributors at any given time. The selected information is then sent to the pressure regulating device, not shown, which is external to the group of distributors.

The function of regulating the output is obtained by ensuring a constant pressure differential in the progressivity slots 49 and 50. These slots control the connections of the feed or annular chamber 27 alternatively with the operating chambers 35 or 38. Calculation shows that the construction illustrated in the drawings allows the difference in pressures between the up-flow and the down-flow of a slot such as 49 or 50 to be held constant, this pressure difference being equal to a fixed factor dependent on the instantaneous compression of the spring 17 and the transverse section of the movable slide 16. The value of this constant pressure difference can be regulated by adjusting the screw 21 to change the force exerted by the spring 17.

Hence, the slots 49 and 50 in the slide 3 control the output flowing through them under a constant difference of pressure. Because of this, the output is solely in relation to the uncovered section of these slots, therefore to the travel of the slide.

It will be understood that the distributor according to the present invention allows the chamber 54 supplying the first and second extrafeed valves 52 and 53 to be connected either to the return chamber 36 and 39 or to any other source of pressure independent of the return.

Although the best mode contemplated by the inventor for carrying out the present invention as of the filing data hereof has been shown and described herein, it will be apparent to those skilled in the art that suitable modifications, variations, and equivalents may be made without departing from the scope of the invention, such scope being limited solely by the terms of the following claims.

What is claimed is:

1. A proportional hydraulic distributor system comprising:

a stator having a longitudinally extending bore therein;

a slide having a longitudinally extending central axis, said slide being slidable along said centrally axis in said longitudinally extending bore in said stator;

said stator further having return circuit means located therein, said return circuit means having a first return channel communicating with said longitudinally extending bore and a second return channel communicating with said longitudinally extending bore;

pilot pressure means for controlling the sliding of said slide in said longitudinally extending bore of said stator;

a first operating flow passage in said stator;

a second operating flow passage in said stator, one of said first operating flow passage and said second operating flow passage being an inlet passage for hydraulic fluid, the other of said first operating flow passage and said second operating flow passage being an outlet passage for hydraulic fluid;

a feed chamber located in said stator, said feed chamber having a feed channel passage extending into said longitudinally extending bore of said stator, said feed channel passage further being positioned intermediate said first and second operating flow passages for communication therewith;

first longitudinally extending progressively slot means positioned in said slide adjacent said feed channel passage, said first longitudinally extending progressivity slot means in said slide being contiguous said first operating flow passage in said stator when said slide is in a neutral position, such as to communicate with said first operating flow passage and to terminate communication with said feed passage;

second longitudinally extending progressivity slot means positioned in said slide adjacent said feed chamber, said second longitudinally extending progressivity slot means in said slide being contiguous said second operating flow passage in said stator when said slide is in a neutral position, such as to communicate with said second operating flow passage and to terminate communication with said feed channel passage;

said first and second longitudinally extending progressivity slot means in said slide further being juxtaposed said feed channel passage such that as said pilot pressure means moves said slide to a first predetermined position from said neutral position, said first longitudinally extending progressivity slot means communicates said feed channel passage to said first operating flow passage while simultaneously said second longitudinally extending progressivity slots means in said slide communicates with said return circuit means such that further as said pilot pressure means moves said slide to a second predetermined position from said netural position, said second predetermined position being opposite said first predetermined position, said second longitudinally extending progressivity slot means communicates said feed channel passage to said second operating flow passage while simultaneously said first longitudinally extending progressivity slot means in said slide communicates with said return circuit means, the length of said first and second longitudinally extending progressivity slot means in said slide that is in engagement with said first and second operating flow passage, respectively, varying with the position of said slide in said longitudinally extending bore of said stator;

constant pressure generating means mounted in said stator, said constant pressure generating means having:

a compensating slide valve having an end and an opposite end extending into said feed chamber, said opposite end further being slidable in said feed chamber, said compensating slide valve having passage means extending therethrough, said passage means terminating at a seat, said passage means being adapted to communicate with said feed chamber;

ball means being adapted to bear against said seat to interrupt the communication between said passage means and said feed chamber;

resilient means normally urging said ball means against said seat;

spring means acting on said compensating slide valve to exert a first positioning force on said end of said compensating slide valve in said feed chamber; and a load sensing passage means in said stator and slide, said load sensing passage means having one end communicating with one of said first operating flow passage and said second operating flow passage and a second opposite end communicating with the other of said first operating flow passage and said second operating flow passage, said other end of said load sensing passage means further communicating with said one end of said compensating slide valve to exert a second positioning force on said end of said compensating slide valve to generate a constant pressure across said first and second longitudinal extending progressivity slot means when said first and second progressivity slot means are communicating said feed channel passage with said first and second operating flow passage, respectively, as said pilot pressure means moves to said first and second predetermined positions, respectively.

2. A proportional hydraulic distributor according to claim 1 further comprising:

calibration means for calibrating said spring means to adjust said first positioning force exerted by said spring means on said one end of said compensating slide valve.

3. A proportional hydraulic distributor according to claim 2 further comprising:

an extra-feed chamber disposed in communication with said feed chamber and further being communicable with said first operating flow passage in said stator;

a first extra-feed valve for permitting flow from said extra-feed chamber into said first operating flow passage in said stator; and a second extra-feed valve for permitting flow from said second extra-feed chamber into said second operating flow passage in said stator.

4. A proportional hydraulic distributor according to claim 1 further comprising:

an extra-feed chamber disposed in selective communication with said first operating flow passage in said stator and said second operating flow passage in said stator;

a first extra-feed valve for permitting flow from said extra-feed chamber into said first flow passage in said stator; and a second operating extra-feed valve for permitting flow from said extra-feed chamber into said second flow passage in said stator.

* * * * *

UNITED STATES PATENT AND TRADEMARK OFFICE

CERTIFICATE OF CORRECTION

PATENT NO. : 4,736,770

DATED : April 12, 1988

INVENTOR(S) : Tardy et al

It is certified that error appears in the above-identified patent and that said Letters Patent is hereby corrected as shown below:

Column 1, line 40, delete "load sensor" and insert ---- load sensor, ----.

Column 2, line 57, after "by" insert ---- the ----.

Column 3, line 18, after "in" insert ---- a ----.

Column 3, line 39, delete "be" and insert ---- by ----.

Column 4, line 61, delete "and" and insert ---- to ----.

Column 5, line 22, delete "extrafeed" and insert ---- extra-feed ----.

Column 5, line 27, delete "data" and insert ---- date ----.

In the Claims

Column 5, line 39, delete "centrally" and insert ---- central ----.

Column 5, line 63, delete "progressively" and insert ---- progressivity ----.

UNITED STATES PATENT AND TRADEMARK OFFICE

CERTIFICATE OF CORRECTION

PATENT NO. : 4,736,770

DATED : April 12, 1988

INVENTOR(S) : Tardy et al

Sheet 2 of 2

It is certified that error appears in the above-identified patent and that said Letters Patent is hereby corrected as shown below:

Column 7, line 3, delete "longitudinal" and insert ---- longitudinally ----.

Column 8, line 19, after "second" insert ---- operating ----.

Signed and Sealed this

Twenty-fourth Day of January, 1989

*Attest:*

*Attesting Officer*

DONALD J. QUIGG

*Commissioner of Patents and Trademarks*